US009242167B2

(12) United States Patent
Shute et al.

(10) Patent No.: US 9,242,167 B2
(45) Date of Patent: Jan. 26, 2016

(54) SKI BINDING HEEL UNIT

(71) Applicant: G3 Genuine Guide Gear Inc., North Vancouver (CA)

(72) Inventors: Cameron Allan Shute, Nelson (CA); Robert Erik Moore, North Vancouver (CA)

(73) Assignee: G3 Genuine Guide Gear Inc., Burnaby (CA)

( * ) Notice: Subject to any disclaimer, the term of this patent is extended or adjusted under 35 U.S.C. 154(b) by 0 days.

(21) Appl. No.: 14/327,010

(22) Filed: Jul. 9, 2014

(65) Prior Publication Data

US 2015/0014963 A1 Jan. 15, 2015

Related U.S. Application Data

(60) Provisional application No. 61/844,229, filed on Jul. 9, 2013.

(51) Int. Cl.
*A63C 9/08* (2012.01)
*A63C 9/084* (2012.01)
(Continued)

(52) U.S. Cl.
CPC ..... *A63C 9/0845* (2013.01); *A43B 5/0417* (2013.01); *A43B 5/0496* (2013.01); *A63C 7/102* (2013.01); *A63C 7/1026* (2013.01); *A63C 9/086* (2013.01); *A63C 9/0807* (2013.01); *A63C 9/0843* (2013.01); *A63C 9/0846* (2013.01); *A63C 9/08528* (2013.01)

(58) Field of Classification Search
CPC ..... A63C 9/0807; A63C 9/082; A63C 9/0845
USPC ..... 280/629, 614
See application file for complete search history.

(56) References Cited

U.S. PATENT DOCUMENTS 3,241,849 A * 3/1966 Bodycomb ..... 280/623
3,951,424 A * 4/1976 Napflin ..... 280/618
(Continued)

FOREIGN PATENT DOCUMENTS

AT 402020 1/1997
CA 2360819 7/2000
(Continued)

OTHER PUBLICATIONS

Geze Alpine Binding Adapter for Backcountry Skiing Randonnee—Virtual Museum. (http://www.wildsnow.com/backcountry-ski-museum/geze-1960s-adapter/geze-touring-at-adapter-1960s.html). 2 pages. Jun. 24, 2009.
(Continued)

*Primary Examiner* — Hau Phan
*Assistant Examiner* — Bryan Evans

(57) ABSTRACT

An apparatus for selective holding of a footwear heel to a snow travel aid is provided. The apparatus is of the kind that comprise a base mountable to the snow travel aid, an upper portion slidable relative to the base and at least one forward connector for connecting the upper portion to the heel. The upper portion is rotatable on a generally vertical axis between a downhill position and at least one lateral release position. In this invention, the upper portion comprises at least one camming surface positioned such that rotation of the upper portion toward the lateral release position results in the upper portion translating rearwardly against an opposing force provided by a forward biasing device.

15 Claims, 16 Drawing Sheets

(51) Int. Cl.

| | |
|---|---|
| ***A43B 5/04*** | (2006.01) |
| ***A63C 7/10*** | (2006.01) |
| ***A63C 9/085*** | (2012.01) |
| ***A63C 9/086*** | (2012.01) |

(56) References Cited

U.S. PATENT DOCUMENTS

| | | | | |
|---|---|---|---|---|
| 4,261,595 | A | 4/1981 | Smialowski et al. | |
| 4,273,355 | A | 6/1981 | Storandt | |
| 4,403,788 | A | 9/1983 | Bernard et al. | |
| 4,500,108 | A | 2/1985 | Johnson, III | |
| 4,674,766 | A | 6/1987 | Ramer | |
| 4,887,833 | A | 12/1989 | Bailey | |
| 5,002,303 | A | 3/1991 | Freisinger et al. | |
| 5,318,320 | A | 6/1994 | Ramer | |
| 5,364,118 | A | 11/1994 | Burger et al. | |
| 5,741,023 | A | 4/1998 | Schiele et al. | |
| 6,431,578 | B2 | 8/2002 | Pedersen et al. | |
| 7,104,564 | B2 * | 9/2006 | Martin et al. | 280/625 |
| 7,267,356 | B2 | 9/2007 | Buquet et al. | |
| 8,181,985 | B2 | 5/2012 | Mangold et al. | |
| 8,544,869 | B2 | 10/2013 | Lehner | |
| 8,746,728 | B2 | 6/2014 | Shute et al. | |
| 8,820,772 | B2 | 9/2014 | Andersson et al. | |
| 2011/0049821 | A1 | 3/2011 | Trabucchi | |
| 2013/0087992 | A1 | 4/2013 | Ibach et al. | |
| 2013/0181427 | A1 | 7/2013 | Fritschi | |

FOREIGN PATENT DOCUMENTS

| | | |
|---|---|---|
| CH | 619618 | 10/1977 |
| DE | 2806937 | 8/1978 |
| DE | 202012002705 | 8/2013 |
| EP | 0054928 | 6/1982 |
| EP | 0199098 | 10/1986 |
| EP | 0519243 | 12/1992 |
| EP | 1559455 | 8/2005 |
| EP | 1559457 | 8/2005 |
| EP | 1679099 | 7/2006 |
| EP | 2281614 | 2/2011 |
| EP | 2351603 | 8/2011 |
| EP | 2545966 | 1/2013 |
| EP | 2570160 | 3/2013 |
| EP | 2638937 | 9/2013 |
| EP | 2656884 | 10/2013 |
| EP | 2659939 | 11/2013 |
| FR | 2613949 | 10/1988 |
| FR | 2903322 | 1/2008 |
| IT | 0001360160 | 1/2005 |
| WO | 2007060219 | 5/2007 |
| WO | 2009105866 | 9/2009 |
| WO | 2012024809 | 3/2012 |

OTHER PUBLICATIONS

Alpine Touring Bindings-Dynafit Rental Plate. Apr. 13, 2004. (http://telemark-pyrenees.com/Bindings-AT.htm). 5 pages. Jun. 15, 2012.
Click-Clack Dynafit Aftermarket Heel Unit-Review—The Backcountry Skiing Blog. May 29, 2006. (http://www.wildsnow.com/277/click-clack-dynafit-aftermarket-heel-unit-review). 5 pages. Posted by Lou Dawson. May 28, 2013.
ION G3 Tech (Pintech) Binding 2014—First Look Review (https://wildsnow.com/11763/ion-g3-ski-binding-backcountry-tech/) pp. 2/26-13/26. Jan. 6, 2014.
International Search Report for PCT/CA2009/000206 (WO2009105866). Completed Jun. 9, 2009. 6 pages.
Written Opinion of the ISA for PCT/CA2009/000206 (WO2009105866). Mailed Jun. 17, 2009. 6 pages.
Supplementary Search Report from EP application No. 09716177.2 based on WO1009105866 dated Aug. 5, 2014, 9 pages.
English abstract & title for CH619618.
EPO Examination Report for EP2259850; Jul. 8, 2015.
English abstract & title for FR2613949.
EPO Communication dated Jul. 10, 2015 for EP2259850 containing Third Party Observations on FR2613949.
English abstract & title for EP2351603.
English abstract & title for EP2656884.

* cited by examiner

SKI BINDING HEEL UNIT

RELATED APPLICATIONS

This applications claims the benefit of U.S. provisional application No. 61/844,229 filed Jul. 9, 2013, which is incorporated herein by reference.

FIELD OF THE INVENTION

This invention relates to release bindings used in alpine ski touring, also known as "Randonnee".

BACKGROUND OF THE INVENTION

Alpine touring bindings allow the heel of the user's footwear (such as a ski boot) to be latched to a snow travel aid (such as a ski) for sliding downhill (the "downhill mode") and allow the heel to be released for walking and climbing (the "touring mode"). Thus, the binding allows for selective holding of the footwear heel to the snow travel aid so that the user may select between the downhill mode and the touring mode. Modem alpine touring bindings allow the footwear to release from the snow travel aid when in the downhill mode, in case of a fall. When in the touring mode, the user may climb or walk with a great degree of freedom since the footwear is pivotally engaged with the aid near the toe of the footwear while the heel of the footwear is free to move upward and downward relative to the aid. A historical collection of such bindings can be viewed in the "Virtual Museum of Backcountry Skiing Bindings" at www.wildsnow.com, authored by Louis Dawson.

Alpine touring bindings sold under the brand DYNAFIT are bindings that take advantage of the fact that modern alpine touring boots have a rigid sole. Thus, it is unnecessary to provide a bar, plate or other arrangement connecting the toe and heel units, as is the case with many other alpine touring bindings (see patent publications EP0199098, EP0519243, EP1559457, and AT402020).

The DYNAFIT™ binding system comprises a toe unit which has a set of jaws that pivotally engage a special insert in the footwear sole. The toe unit is mountable at an appropriate location on the upper surface of a snow travel aid. A separate heel unit is mountable at a particular region on the upper surface rearward of the toe unit, the location of which is dictated by the length of the footwear sole. The toe and heel units function independently in retaining the footwear attached to the snow travel aid. The heel unit comprises projections (typically a pair of pins) which extend forward to engage opposite sides of a fitting placed over a cavity in the rear of the footwear heel. Under forward release conditions, the pins are intended to be forced apart against spring pressure to respective release positions to disengage from the fitting and the heel. The pins typically communicate with a spring or springs through inclined sliding surfaces that move a block which engages the spring or springs.

Fore and aft adjustment of the DYNAFIT™ heel unit to position the pins at an optimum depth in the heel fitting and to accommodate a limited range of different footwear sizes is provided by means of a threaded adjuster that moves a main portion of the heel unit relative to a base plate which is fixed to the upper surface of the snow travel aid. This is a fine adjustment that must be carried out by means of numerous rotations of a threaded adjuster, through the application of a tool such as a screwdriver or hex key.

The heel unit of a DYNAFIT™ binding provides lateral release primarily as a result of the body of the heel unit which contains the pins being pivotally engaged on a vertical post. Variable release settings are provided by adjusting compression of a spring that is internal to the body which forces a plunger against flat regions arranged on the post circumference.

To switch between touring and downhill modes with the DYNAFIT™ system, it is necessary to rotate the heel unit so that the pins either engage the footwear heel (downhill mode) or face away from the heel (touring mode). When the pins are facing away, the footwear heel is free to move upward and downward. A series of steps on the heel unit may also be provided which, upon rotation of the heel unit to different positions in the touring mode, allow the heel to be supported at varying heights above the snow travel aid to provide comfort during climbing. In order to switch from downhill mode to touring mode it is necessary to release the pins from the fitting on the heel such as by disengagement of the toe unit from the footwear, so that the footwear completely exits from the binding system whereupon the heel unit may be rotated to a position in the touring mode. A DYNAFIT™ type heel unit can also rotate on its own while in the tour mode, occasionally causing the heel unit to inadvertently switch to the downhill mode.

The snow brake for the DYNAFIT™ binding is positioned to not contact snow while in the touring mode by the user forcing the heel plate of the brake downwards while simultaneously rotating the heel unit to a position in the touring mode. This requires a manual activity on the part of the user, which can be difficult to accomplish while in deep snow or when poised in a precarious location.

A variation on a DYNAFIT™ type of binding is shown in WO 2009/105866 where the heel unit is adapted to translate forward and rearward, preferably by a single motion of an actuator to allow for engagement and disengagement of pins from the heel fitting without rotation of the heel unit. This allows the user to change the binding between downhill and touring modes while keeping the boot engaged with a toe piece. The type of binding illustrated in WO 2009/105866 does not rotate except during lateral release whereupon the binding returns to a normal position as a result of a biasing force exerted by lateral (Mz) release components of the binding. Also, translation forward and rearward of the binding in WO 2009/105866 may be used to change a ski brake from a stowed position for use in touring to a release position for use in downhill skiing whereby release of a boot from the binding in a fall will result in the snow brake being engaged with the snow surface.

SUMMARY OF THE INVENTION

Various embodiments of this invention provide an apparatus for selective holding of a footwear heel to a snow travel aid. The apparatus may comprise: a base mountable to the snow travel aid and an upper portion slidably engageable with the base and having a connector for connecting the upper portion to the heel. The upper portion may comprise Mz and My release components. The upper portion is rotatable on a generally vertical axis between a downhill position and at least one lateral release position. The upper portion further comprises at least one camming surface such that rotation of the upper portion results in the at least one camming surface contacting a stop causing the upper portion to translate away from the stop (which would be in a rearward direction when mounted on the snow travel aid) against the biasing force of a biasing device. The Mz and My release components typically include biasing devices and the aforementioned biasing device for urging the upper portion against the stop is separate from any biasing devices of the Mz and My release components.

In some embodiments, the stop against which the upper portion is biased may be on a chassis which is also slidably engaged with the base plate. The chassis may be used for mounting a snow brake. The upper portion or the upper portion in combination with such a chassis may be positionable as a unit by means of an adjustor such a threaded screw for adjusting the position of the heel unit components relative to the heel of a user's footwear. The connector may be one or more pins which are adapted to engage in a fitting in the heel. The heel unit may be adjusted to have a gap between the upper portion and the heel or may be adjusted so that there is very little or no clearance between the upper portion and the heel when the binding is in the downhill mode. The latter positioning allows for constant placement of the boot heel fitting relative to the connector. Where the connector is one or more pins as in a DYNAFIT™ binding, consistent placement of the boot heel relative to the pins allows for more consistent release characteristics. In order to compensate for compressive forces on the ski that causes the heel unit to be pushed forward against the heel of the footwear, the upper portion of the heel unit will translate rearward relative to the footwear heel against the force of the biasing device. Upon release of a compressive force, the biasing device will cause the upper portion of the heel unit to return to its normal position in the downhill mode. In some embodiments, such a biasing device can be used to pre-load the heel unit against the footwear heel to achieve higher release values.

Rotation of the heel unit to a touring position causes the upper portion to translate rearward relative to the stop against the force of the biasing device. A catch or other means may be provided to restrain the heel unit in the touring position so that it will not return to the downhill position under the force exerted by the biasing device unless intended by the user. A locking device may also be provided to hold the upper portion in the touring position to prevent accidental dislodgement and return of the upper portion to the downhill position which may occur with snow build up, etc.

Embodiments of this invention permit the use of a rotatable-type heel unit which can be translated rearward to provide sufficient clearance for the footwear heel in the touring position. This allows for placement of the heel unit close to or against the heel of the footwear to provide for more consistent release characteristics.

The feature of the present invention whereby the upper portion of the heel unit is translated rearward when changing to a touring position allows for the use of a snow brake which is engaged or disengaged as a result of forward/rearward translation of the heel unit. Advantages of such a snow brake as compared to the snow brake of a DYNAFIT™ binding are described in WO 2009/105866. Such a brake comprises a brake holder movable in response to movement of the upper portion for holding the brake in a raised position when the upper portion is in a touring position.

Various embodiments of this invention provide the aforementioned apparatus mounted to a snow travel aid. In some embodiments, the snow travel aid is a ski and the footwear is a ski boot.

Various embodiments of this invention provide a binding kit comprising toe and heel units, each unit for selectively holding a footwear to a snow travel aid. The heel unit is a heel unit as described above. The toe unit will be configured to function independently from the heel unit to retain the footwear toe on the snow travel aid while permitting forward and rearward movement of the footwear. The kit may further comprise instructions for one or more of installation, maintenance, adjustment and use of the toe and heel units. The kit may further comprise fasteners such as appropriate threaded fasteners for attachment of the toe and heel units to a snow travel aid. In some embodiments, the toe and heel units will not be connected except through mounting on a snow travel aid.

DETAILED DESCRIPTION OF PARTICULAR EMBODIMENTS OF THE INVENTION

Snow travel aids as contemplated herein are devices that support a user and are adapted to slide on a snow surface. Examples include skis, other snow sliding devices shaped like a ski and snowboards. This includes devices known as "splitboards" (which are snowboards that can be separated longitudinally into at least two portions, the two portions then functioning in a manner similar to a pair of skis). Examples of such other devices include "ski blades", "snow blades", "ski boards", and "sliding" or "gliding snow shoes". An example of the latter device is the configurable snow shoe/ski device described in WO 2000/044846.

In this specification, reference to "Mz" refers to the lateral release characteristic that involves torque applied about an axis that is generally perpendicular to the upper surface of a snow travel aid. The term "My" refers to the forward release characteristic whereby torque is applied about an axis that is generally parallel to the upper surface and generally perpendicular to the longitudinal axis of the snow travel aid.

In this specification, reference to "generally vertical" is intended to indicate a general direction upwards or downwards from a reference but does not require perpendicularity to such reference. Conversely, the term "generally horizontal" includes directions that are perpendicular to those which are "generally vertical" but is not limited to situations involving a line or a plane parallel to the reference. The terms "generally horizontal" and "generally parallel" as used herein include lines or planes that are parallel to a reference as well as those which form an angle of less than 45 degrees with the reference. The term "generally perpendicular" is not limited to a 90 degree orientation but includes orientations that form an angle to a reference of greater than 45 degrees and less than 135 degrees.

Figure 1A:
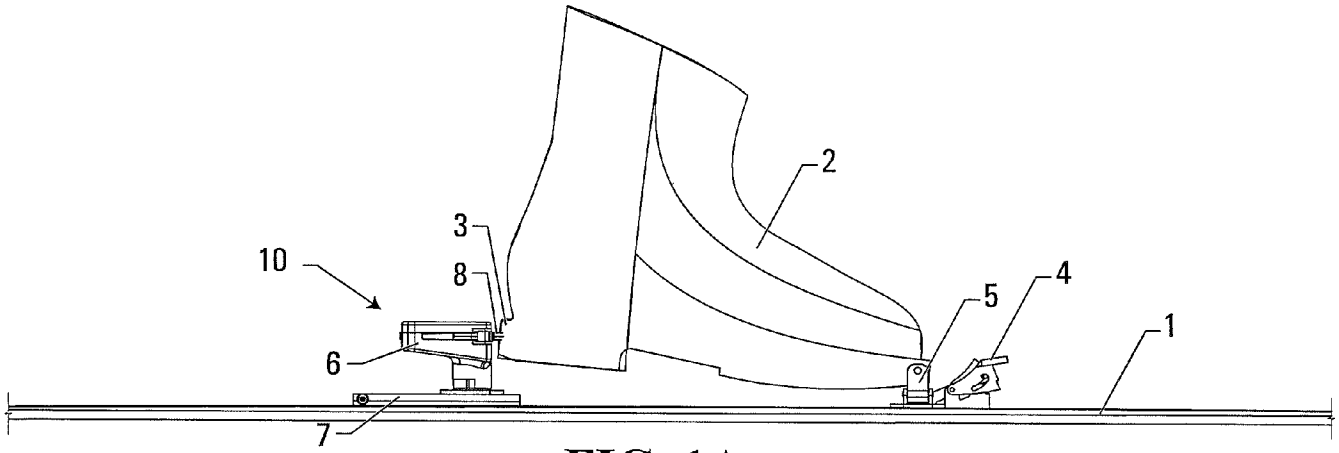
FIG. 1A Prior Art
FIGS. 1A and 1B are side and plan views, respectively of a ski, ski boot and a prior art binding system.
Figure 1B:
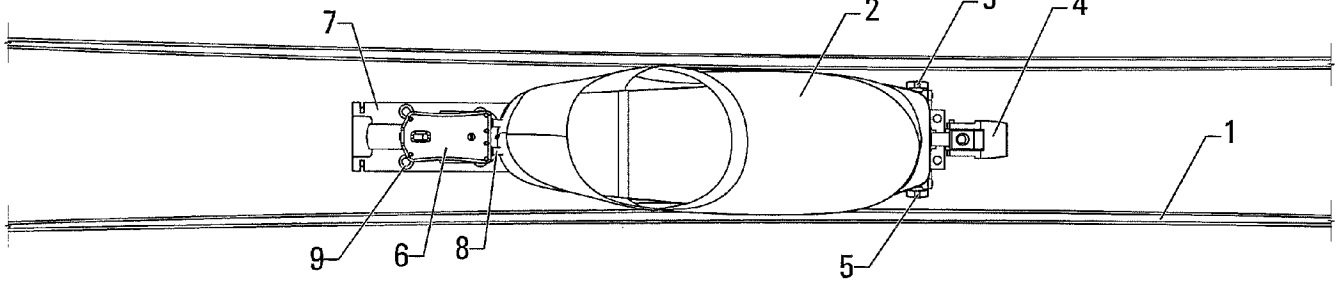
FIG. 1B Prior Art

FIGS. 1A and 1B show the prior art DYNAFIT™ binding system, including toe unit 4 and heel unit 10 mounted on the upper surface of ski 1. The toe unit comprises jaws 5 that pivotally engage with special fittings (not shown) embedded in the toe of ski boot 2. Dual pins 8 on heel unit 10 engage the rear portion of the boot heel 3. The heel unit comprises a base plate 7 fixed to the ski surface by multiple fasteners 9. Upper portion 6 of the heel unit contains forward directed projections, which are illustrated as a pair of pins 8. The arrangement shown in FIGS. 1A and 1B is the downhill mode with both the toe and heel of the boot engaged by the binding system. It should be noted that pins 8 are visible in the downhill mode in a gap between boot heel 3 and a forward side of upper portion 6.

Figure 2A:
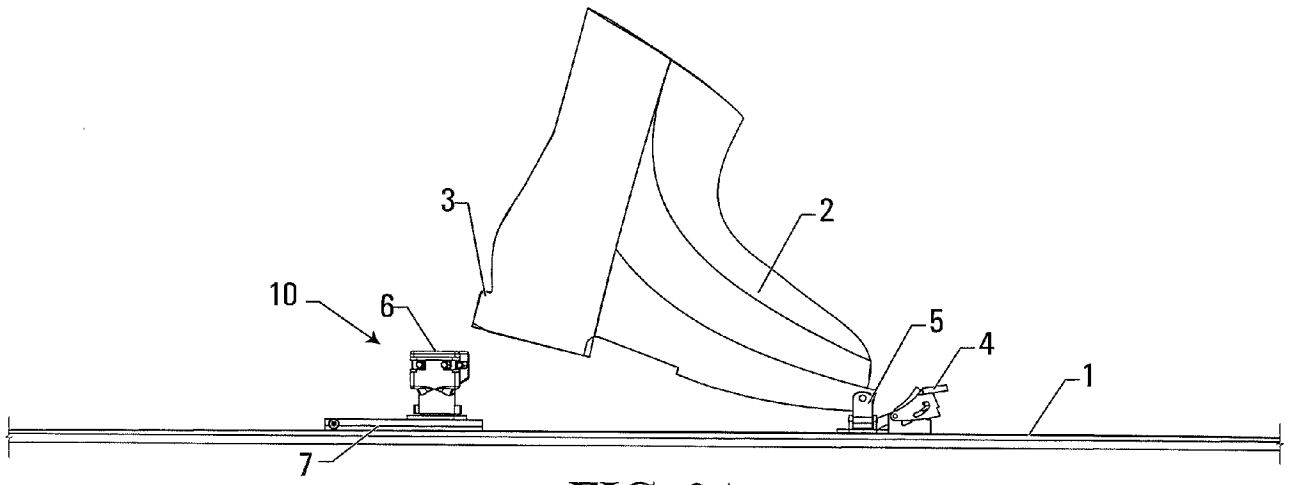
FIG. 2A Prior Art
FIGS. 2A and 2B are side and plan views, respectively showing the combination illustrated in FIGS. 1A and 1B in a touring mode.
Figure 2B:
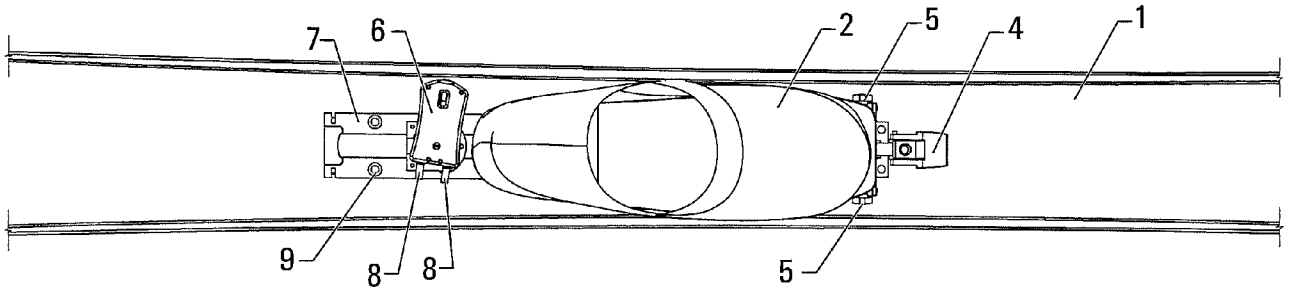
FIG. 2B Prior Art

FIGS. 2A and 2B show the prior art DYNAFIT™ system positioned in the touring mode. The toe of the boot remains pivotally engaged to toe unit 4. The heel is free to move up and down relative to the ski because upper portion 6 of the heel unit has been rotated so that pins 8 face away from boot heel 3. In some DYNAFIT™ models, upper portion 6 may be further rotated (not shown) such that pins 8 face rearward of the ski thereby allowing the boot heel 3 to come to rest on an upper surface of upper portion 6. This reduces stress on the user's muscles and tendons while climbing steep hills. In some embodiments, the upper portion 6 may further comprise a heel lift extension (not shown) or foldable heel lifts to permit the user to further elevate the boot heel while climbing steep hills.

In order to switch from the downhill mode shown in FIGS. 1A and 1B to the touring mode shown in FIGS. 2A and 2B, one must free the pins 8 from the boot heel. One method for doing so is to disengage the boot toe from jaws 5, thereby completing exiting the binding system at which point the user is no longer resting on the ski.

Figure 3:
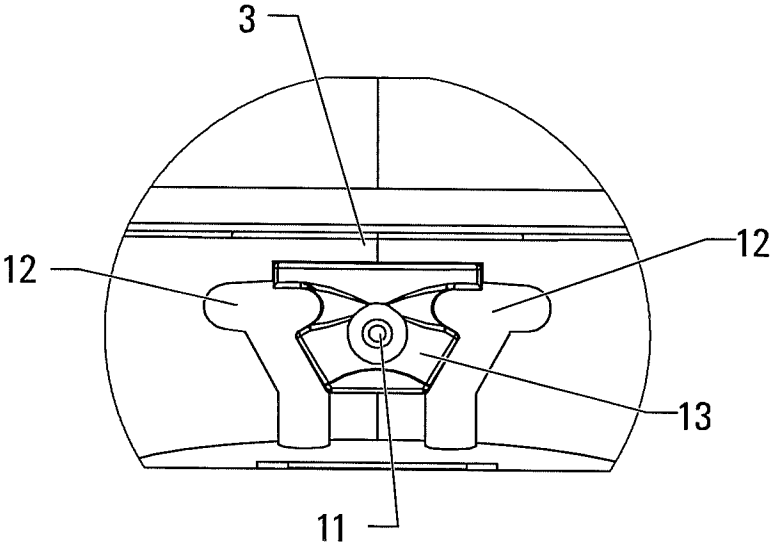
FIG. 3 Prior Art
FIG. 3 is a partial end view of a boot heel containing a prior art fitting for receiving pins of a prior art heel unit.

FIG. 3 shows part of the rear end of a boot and the prior art boot heel fitting adapted to engage the pins of a DYNAFIT™ heel unit. The upper boot is not shown. Metallic insert 13 is fixed to heel 3 by means of fastener 11. Arcuate cut-away portions on opposite sides of the insert accommodate the pins of the heel unit. These arcuate portions are placed over cavities 12 in the boot heel which receive the ends of the pins.

Figure 4A:
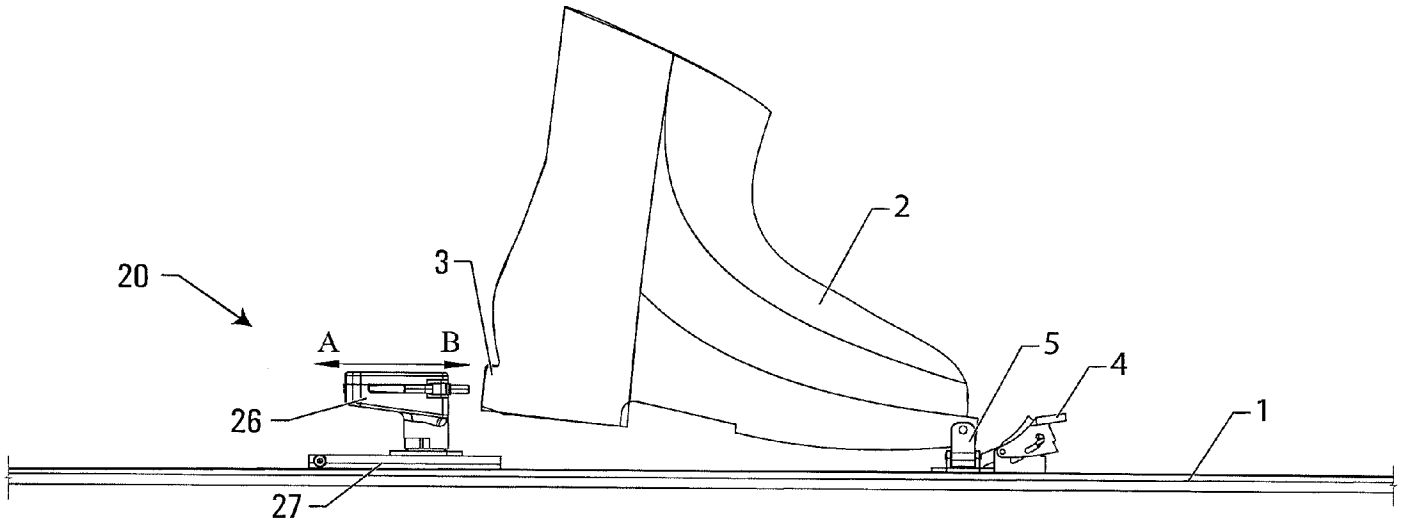
FIG. 4A Prior Art
FIGS. 4A and 4B are side and plan views, respectively of a ski, a ski boot, a toe unit, and of another prior art binding.
Figure 4B:
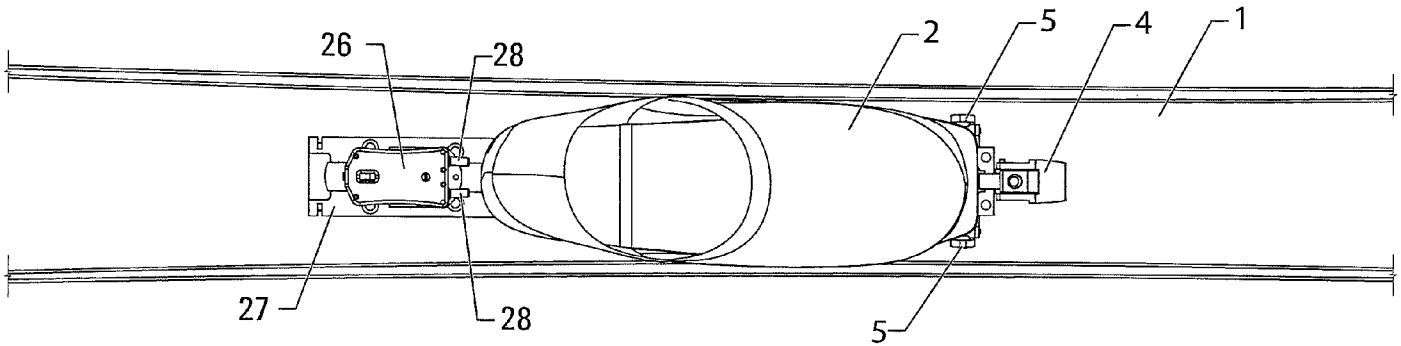
FIG. 4B Prior Art

FIGS. 4A and 4B show operation of a prior art heel unit 20 as described in WO 2009/105866, together with a DYNAFIT™ type of toe unit 4. Upper portion 26 of the heel unit is capable of translating in both directions along the longitudinal axis of the ski as shown by arrow A-B. Pins 28 are shown fully disengaged from the boot heel. By moving the heel unit forward, pins 28 engage boot heel 3. Engagement and disengagement of the pins may be accomplished without removing the boot from the toe unit and without rotating the heel unit.

In the prior art bindings illustrated in FIGS. 1-4, the heel unit of the binding is positioned to provide a gap between the body of the heel unit and the heel of the boot. This positioning is typically done by rotating a threaded adjuster that moves upper portion 6 forward or rearward relative to base plate 7 in the binding shown in FIG. 1. Such an adjustment means was also provided in the prior art binding shown in FIGS. 4A and 4B which was separate from the means used for translating the binding of WO 2009/105866 forward or rearward between downhill and touring positions. Typically, such bindings would have provided about 25 mm of adjustment with any further adjustment requiring a repositioning of the entire heel unit on a ski. It was important to maintain a correct heel unit position to provide the aforementioned gap to allow for the ski flexing during compression whereby the pins would move further into the fitting in the ski boot. A typical gap between the body of the heel unit and the heel of the boot when in the downhill position would be about 5 mm. Shortening of this gap as a result of the ski flexing affects the release characteristics of such a binding making it difficult to provide consistent release characteristics under different compressive forces exerted on the ski.

Figure 5A:
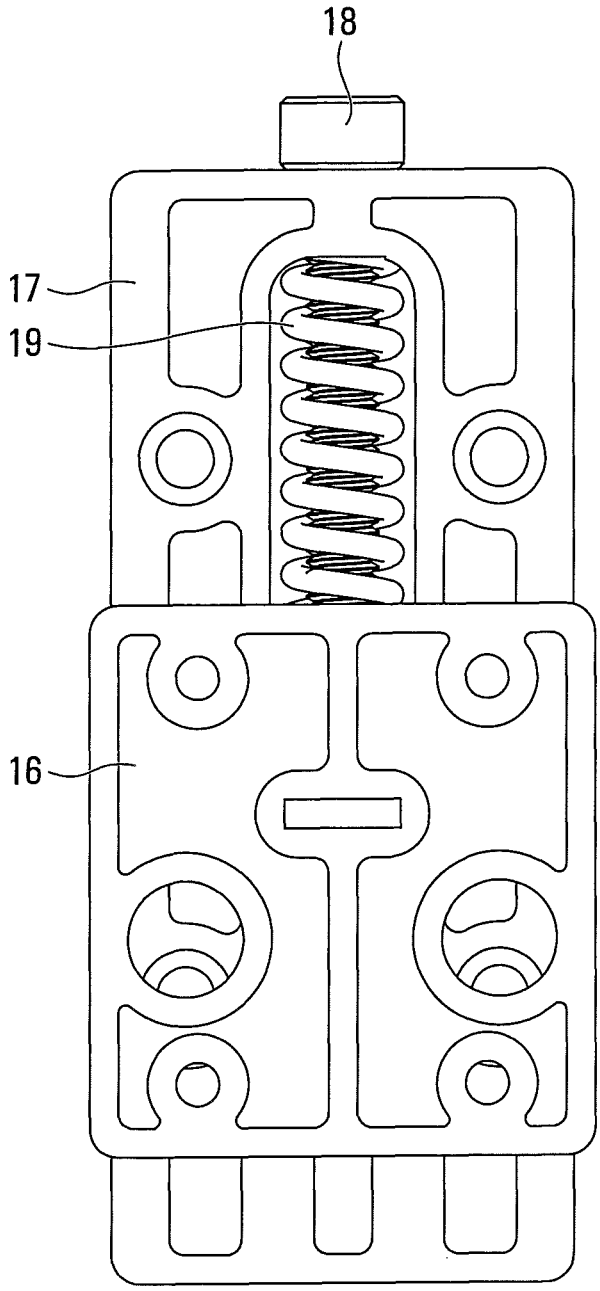
FIG. 5A (Prior Art)
FIGS. 5A to 5C are top, side and bottom views of a prior art mounting plate for rental equipment.
Figure 5B:
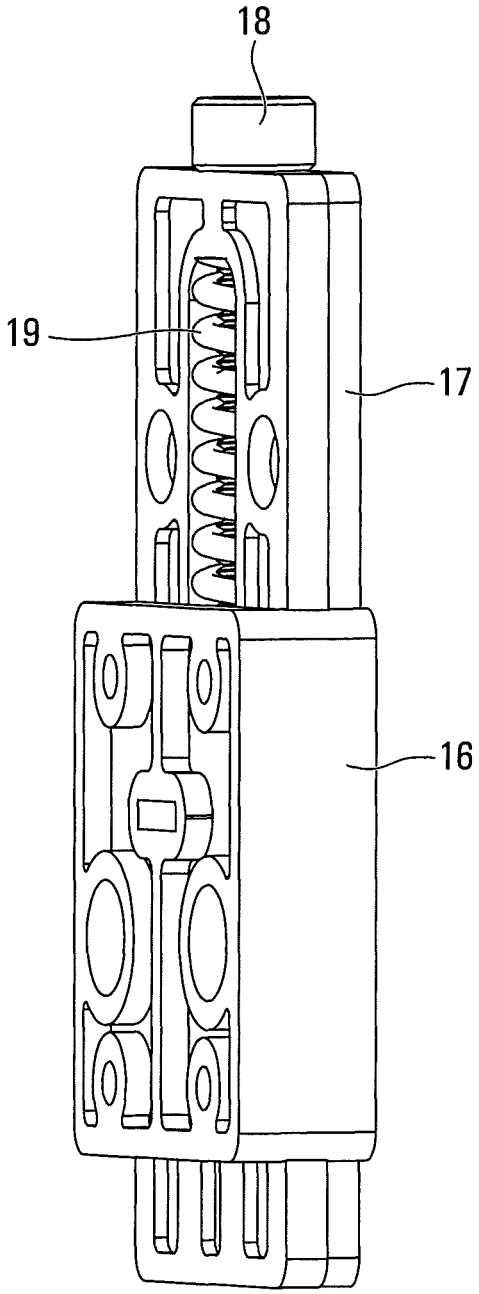
FIG. 5B (Prior Art)
Figure 5C:
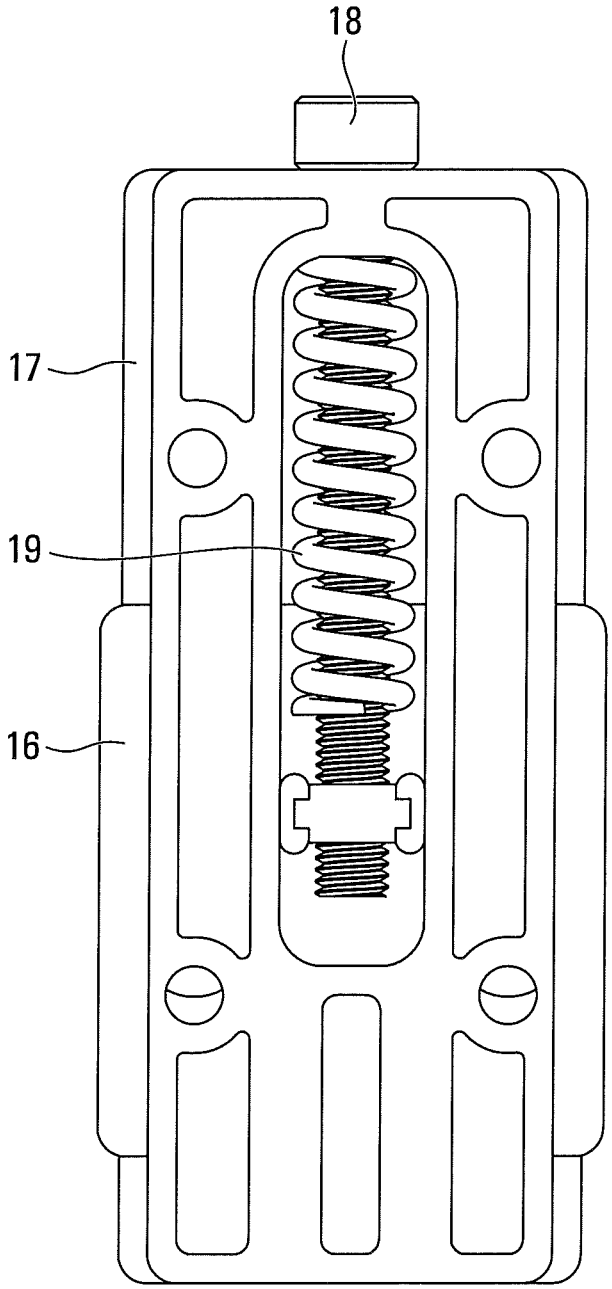
FIG. 5C (Prior Art)

A prior art DYNAFIT™ mounting plate could be sandwiched between base plate 7 and the ski surface to provide a second position adjuster allowing for about 50 mm of movement of the heel unit on the ski. This allowed for greater freedom of use of a particular ski-binding set up for rental purposes. Photographs showing top, side perspective and bottom views of such a DYNAFIT™ rental plate are shown in FIGS. 5A-5C. The rental plate consists of a top plate 16 to be mounted to the bottom of plate 7 of a DYNAFIT™ binding and bottom plate 17 to be mounted to a ski. Adjustment screw 18 is shown as is spring 19. Top plate 16 could translate rearwards against a biasing force exerted by spring 19.

As will be discussed below, various aspects of this invention relate to an apparatus for holding a footwear heel to a snow travel aid. The apparatus comprises a base mountable to the snow travel aid and an upper portion slidable relative to the base and having at least one forward connector for connecting the upper portion to the heel. The upper portion is rotatable on a generally vertical axis between a downhill position and at least one lateral release position. The apparatus further comprises at least one camming surface positioned such that rotation of the upper portion toward the lateral release position results in the upper portion translating rearwardly against an opposing force provided by a forward biasing device. The apparatus may further comprise Mz and My biasing devices separate from the forward biasing device. The camming surface may be a lobe connected to the upper portion. Such a lobe may have an axis of rotation that is generally the same as the axis of rotation of the upper portion. The camming surface may contact a boss that is connected to the base. The apparatus may comprise two lobes on opposite sides of the upper portion, wherein the upper portion is rotatable in opposite directions. The boss may be on a chassis, the chassis being positionable on the base by an adjustor and wherein the upper portion is slidably engaged with the chassis. The apparatus may further comprise a snow brake mounted on the chassis. The upper portion may be releasably retained in a rotated position against the force provided by the forward biasing device. The releasable retaining may be provided by a detent in the camming surface. The detent may engage the boss. The releasable retaining may be provided by the lobe engaging a depression that is fixed relative to the upper portion, with the lobe engaging the depression in the rotated position. The engagement may be facilitated by flexibility of the lobe. The depression may be behind a ramp on which the lobe rides while rotating to the rotated position. Weighting the apparatus by a user may restrict the lobe from disengagement from the depression. This invention also relates to a system or combination that comprises a snow travel aid and a touring binding mounted to the snow travel aid and a boot placed in the binding. The touring binding comprises an apparatus of this invention which may be positioned such that there is no clearance between the heel of the boot and the upper portion of the apparatus, when the apparatus is in the downhill mode (for example, when a pair of pins as described herein are engaged with the boot heel).

Figure 6B:
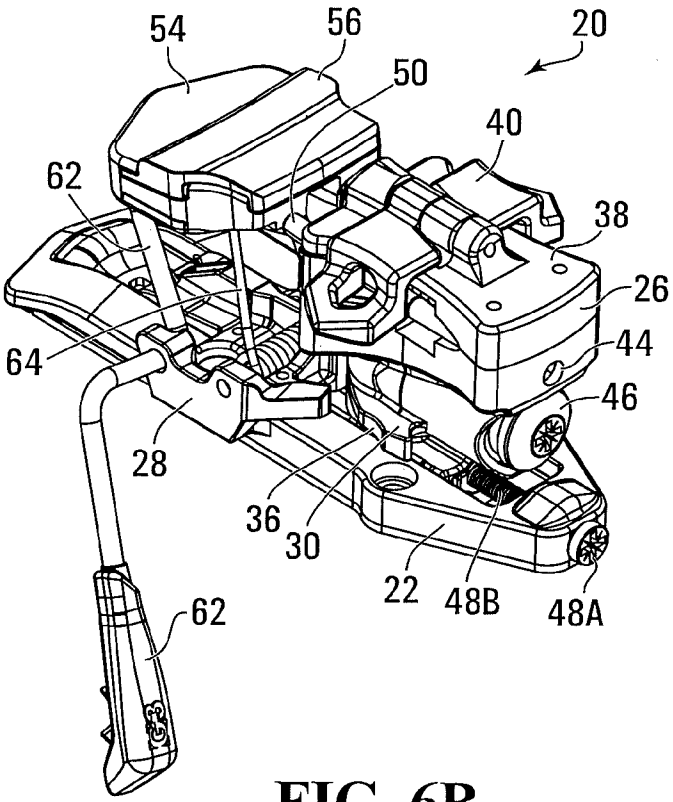
FIGS. 6A and 6B are perspective views of a heel unit of this invention with snow brake positioned for downhill skiing (downhill mode).
Figure 6A:
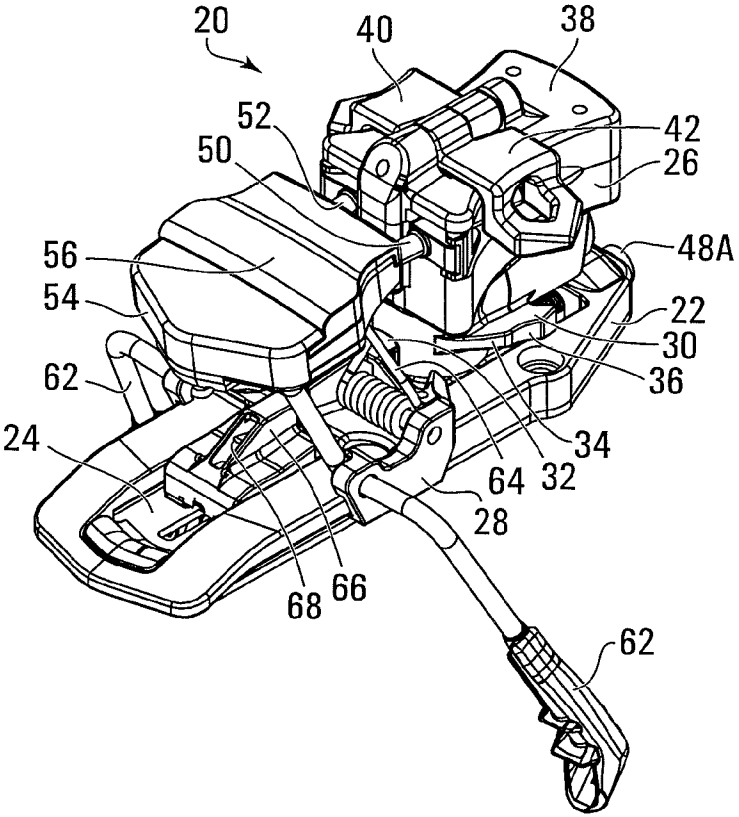

FIGS. 6A and 6B are perspective views illustrating a particular embodiment of this invention in the downhill mode. Heel unit 20 is intended to be mounted to the upper surface of the snow travel aid, by means of fasteners (such as screws) that would extend through apertures in base plate 22. The base plate contains a channel 24 in which upper portion 26 and ski brake chassis 28 are slidably engaged. Upper portion 26 may be similar to the corresponding part of a DYNAFIT™ heel unit except for presence of at least one lobe 30 situated on the exterior of the upper portion body which forms a camming surface that will engage a stop that is fixed relative to the upper portion. In this embodiment, boss 32 on the brake chassis functions as such a stop when the upper portion is rotated to place the heel unit in the touring position. In the embodiment illustrated, matching lobes 30 are placed on opposite sides of the upper portion and will alternately engage boss 32 depending upon the direction in which the upper portion is rotated. In this embodiment, lobe 30 comprises camming surface 34 and detent 36. Engagement of detent 36 with boss 32 will assist in retaining the upper portion in a touring position. Cover 38 on upper portion 26 is removable for access to an interior portion of upper portion 26 containing the My release components. Stowable heel lifts 40 and 42 are attached to the cover and provide different elevated platforms on which to rest the boot heel when the binding is in the touring mode. Adjustment of pre-load on the My release components is by means of an adjustor accessed through aperture 44. Mz adjustor/spring cap 46 is turned to adjust pre-load on the Mz release components which are contained within upper portion 26 beneath the My release components. Positioning of the upper portion 26 and brake chassis 28 within channel 24 of base plate 22 is accomplished by rotating the head 48A of an adjustor having a threaded portion 48B. The My release components comprise a pair of pins 50 & 52 which extend forward and are for engagement in an appropriate fitting in the boot heel. Brake pad 54 contains sliding cover 56 which acts as an anti-friction device (AFD). A pair of brake arms 62 extend through apertures in chassis 28 and are rotatably engaged with brake pad 54. Spring 64 biases the brake pad upwards and the brake arms downwards when the binding is in the downhill position and no boot is engaged in the binding. Located on chassis 28 is housing 66 containing hook 68 which is for engagement with a portion of spring 64 to retain the brake in a touring position with pad 54 depressed and arms 62 raised above the snow surface.

Figure 7B:
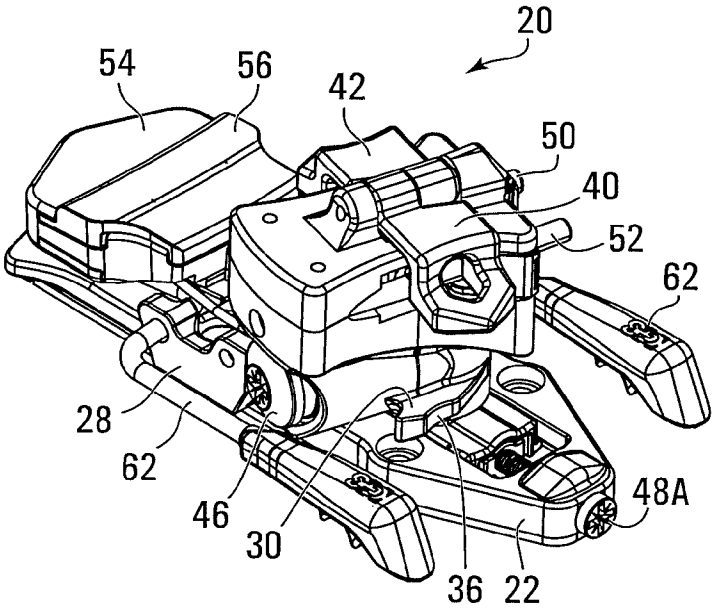
FIGS. 7A and 7B are perspective views of the heel unit shown in the preceding drawing positioned for touring (touring mode).
Figure 7A:
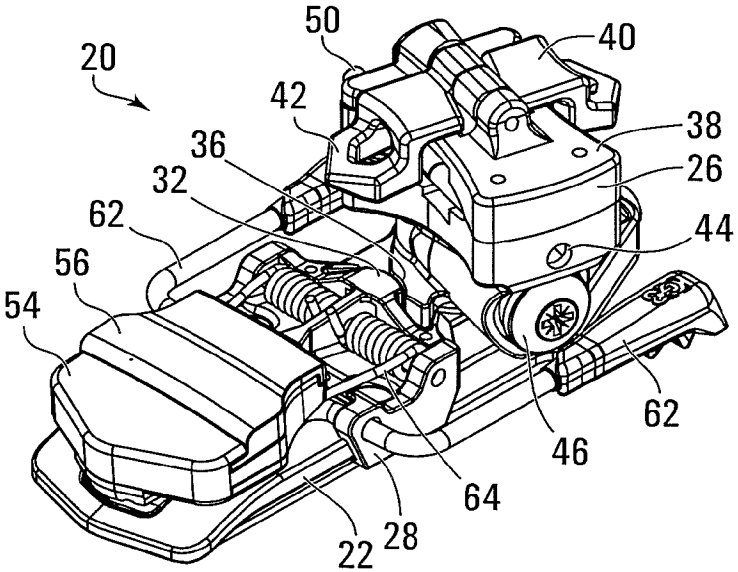

FIGS. 7A and 7B illustrate perspective views of the heel unit shown in FIGS. 6A and 6B when in a touring position. Upper portion 26 has been rotated so that pins 50 and 52 are directed toward the side of the heel unit and cannot engage the boot heel. The ski brake is in the touring position with brake pad 54 held in the depressed position so that the boot is free to move up and down without the brake being engaged. Brake arms 62 are in the raised position so they will not contact the snow surface. As shown in FIG. 7B, one of lobes 30 is not engaged whereas the lobe on the opposite side of upper portion 26 is engaged at detent 36 on boss 32. When rotating to the position shown in FIG. 7A, cam surface 34 travels along boss 32 causing upper portion 26 to be translated away from chassis 28 to provide clearance for the boot heel during touring. In this embodiment, translation of upper portion 26 away from chassis 28 also causes hook 68 to engage the brake and retain it in the touring position. Heel lift 42 shown in FIG. 7A may be pivoted away from the boot to allow the boot heel to pass in front of upper portion 26 and rest on snow plate 70. Snow plate 70 is shaped to help break up snow and/or ice that may build up beneath the boot heel.

Figure 8:
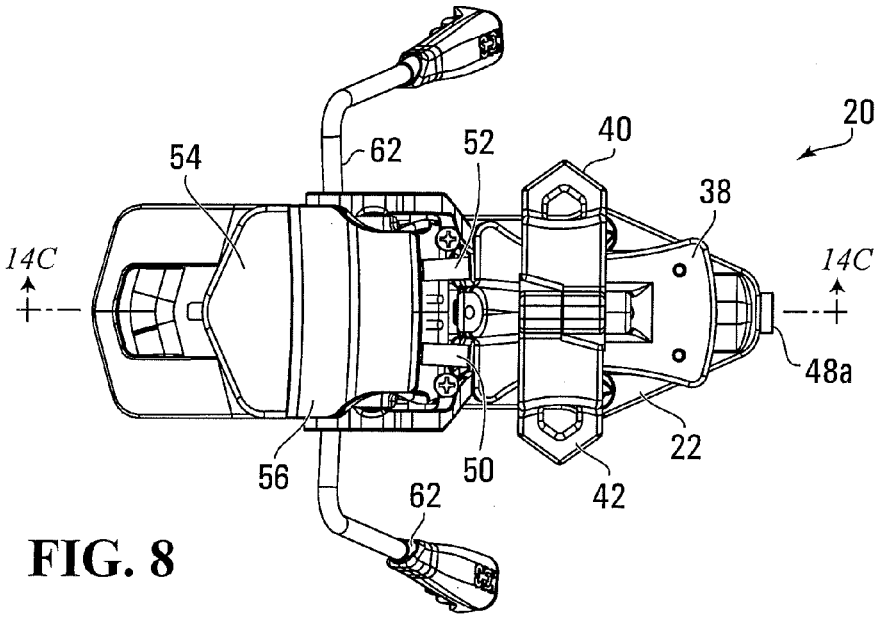
FIG. 8 is a top view of the heel unit shown in FIGS. 6 and 7.
Figure 9:
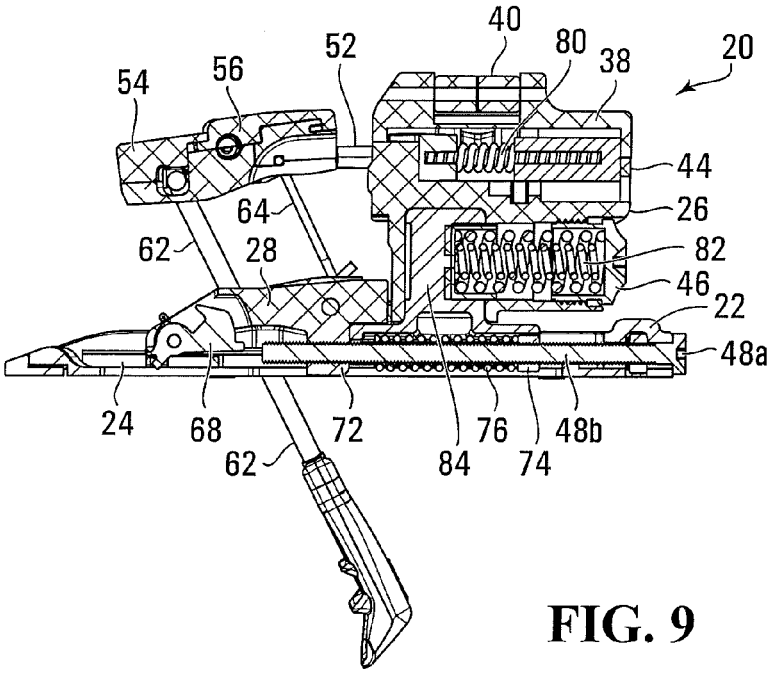
FIG. 9 is a cross sectional view taken along line A-A of FIG. 8.

FIG. 8 is a top view of the heel unit shown in FIGS. 6A and 6B in the downhill position. FIG. 9 is a cross sectional view along line A-A of FIG. 8. Threaded portion 48B of the adjustor is engaged in a threaded through-hole 72 at the bottom of brake chassis 28. Mounted on the adjustor is adjustable spring retainer 74 which bears against spring 76 which in turn biases upper portion 26 against chassis 28. Rotation of the adjustor at 48A results in the upper portion 26 and chassis 28 moving forward or backward in channel 24 of track 22 as a single unit. However, rotation of upper portion 26 such that either of lobes 30 exerts a camming effect against chassis 28 causes upper portion 26 and the chassis to be separated against the biasing effect of spring 76.

The cross section view in FIG. 9 shows spring 80 which is part of the My release components and coaxially arranged spring unit 82 which is part of the Mz release components.

Figure 10:
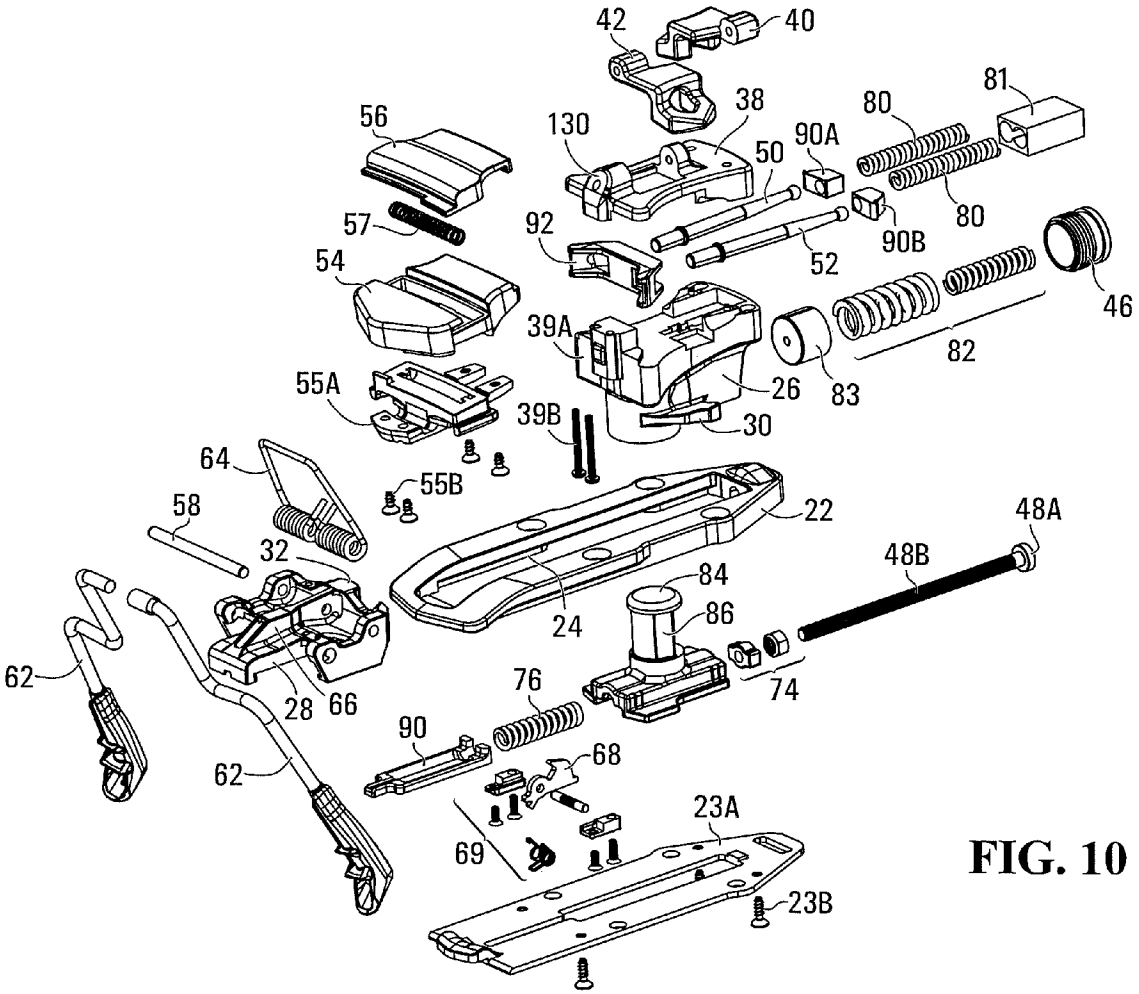
FIG. 10 is an exploded view of the heel unit illustrated in FIGS. 6-9.

FIG. 10 is an exploded view of the heel unit illustrated in FIGS. 6-9. Base plate 22 comprises lower plate 23A which is joined to the base plate with appropriate threaded fasteners 23B. Post 84 is slidably engaged in channel 24 of base plate 22 and is placed within a hollow part of upper portion 26. Upper portion 26 is retained on post 84 by engagement of Mz plunger 83 on flat portion 86 of the post. Plunger 83 is retained against the flat portion by means of Mz springs 82 which are adjusted by the position of cap 46. Also shown are My springs 80, My spring base 81, pin caps 90A and 90B, pins 50 and 52 and release arm 92 which are My release components. Cover 38 is retained on upper portion 26 by being cinched through boss 39A by means of fasteners 39B which extend upward through the boss and engage with appropriate threaded openings in cover 38. One end of finger 90 is engaged underneath post 86 and the finger extends forward to contact hook 68 which is part of brake release components 69. When the binding is in the downhill position, finger 90 is translated forward and contacts the bottom of hook 68 disengaging it from a corresponding portion on spring 64. When upper portion 26 is rotated such that one of lobes 30 contacts boss 32 and the upper portion is translated rearward relative to brake chassis 28 against the biasing force of spring 76, finger 90 moves rearward allowing hook 68 to rotate forwards (assisted by its spring) to be available to engage a corresponding portion on spring 64 when brake pad 54 is depressed, thereby retaining the brake pad in the depressed position with arm 62 raised above the snow, so as to not interfere with touring. Arms 62 are sandwiched between brake pad 54 and lower brake element 55A which is attached to brake pad 54 through appropriate fasteners 55B. Sliding cover 56 is retained in position by spring 57. Axel 58 retains spring 64 in brake chassis 28.

Figure 11A:
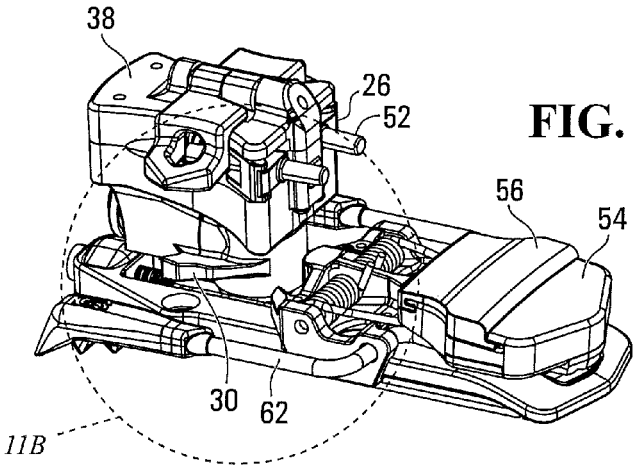
FIGS. 11A, 12A and 13A are perspective views of a heel unit of this invention positioned for downhill (FIG. 11A) for touring (FIG. 13A) and in an intermediate position (FIG. 12A).
Figure 11B:
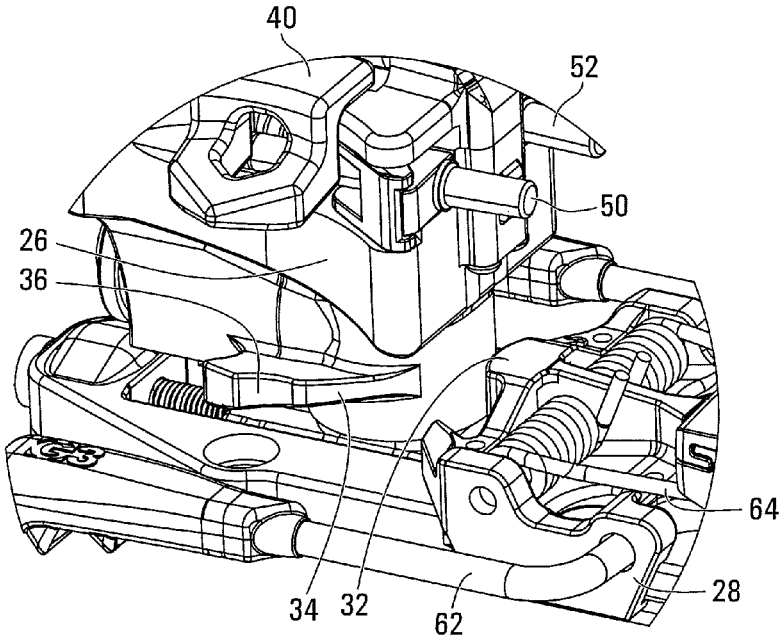
FIGS. 11B, 12B and 13B are enlargements of sections B, C and D of FIGS. 11A, 12A and 13A, respectively.
Figure 12A:
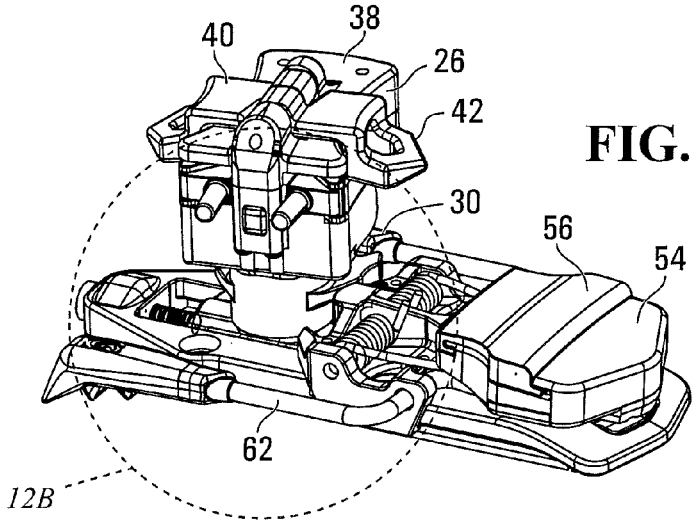
Figure 12B:
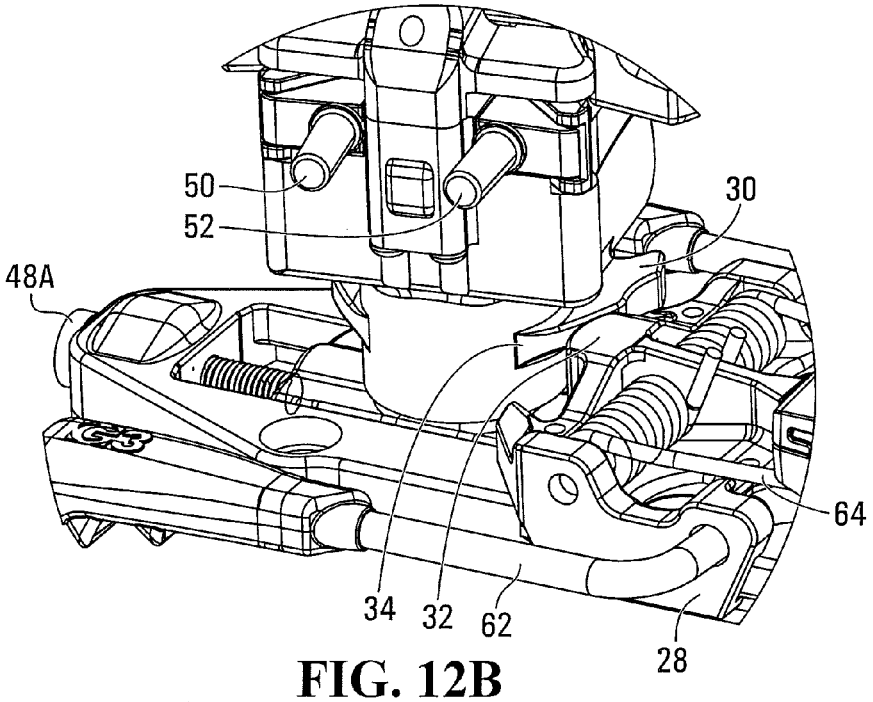
Figure 13A:
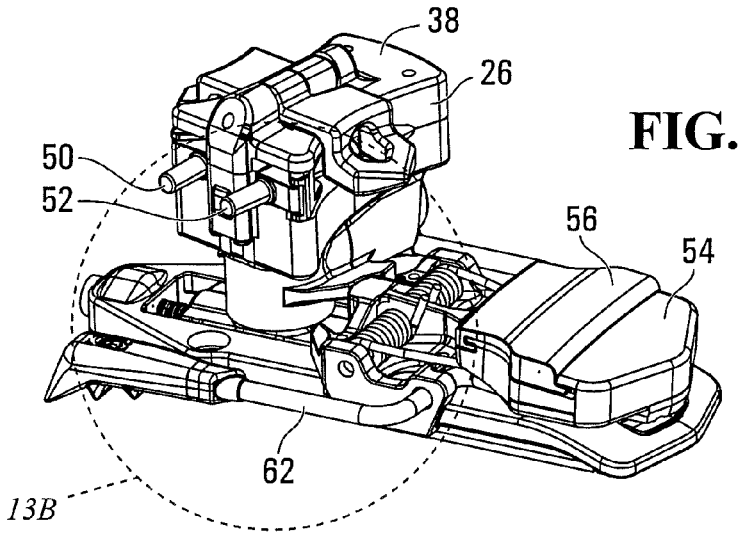
Figure 13B:
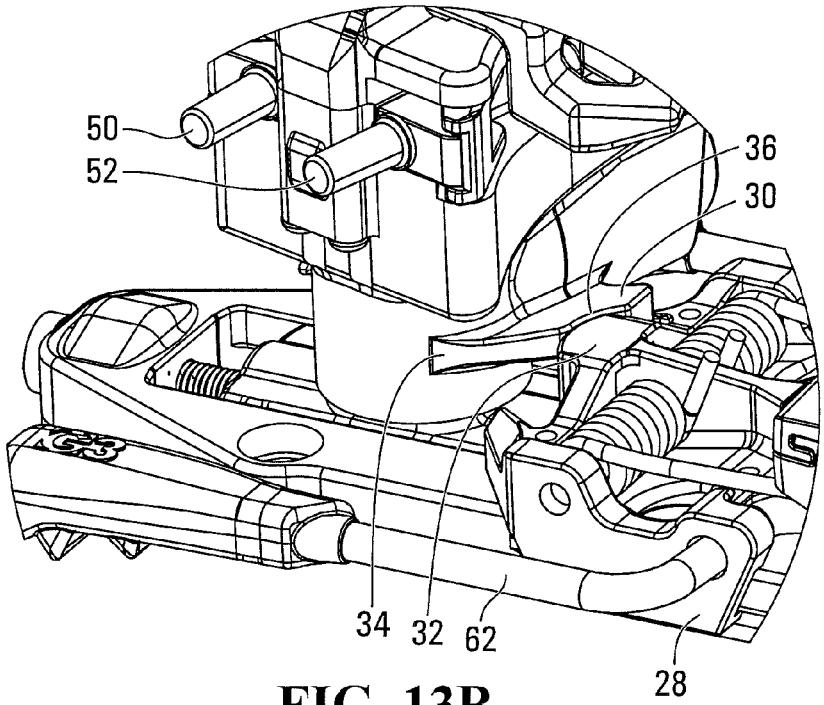

FIG. 11B is an enlarged view of a section of FIG. 11A showing a heel unit of this invention in a downhill position. Typically when in the downhill position, the brake pad 54 is raised and brake arm 62 dropped unless a boot is engaged in the binding. For illustration purposes, FIGS. 11A and 11B show the brake pad in the depressed position as if a boot were engaged in the binding. Similarly, FIGS. 12A and 12B show the binding with upper portion 26 partially rotated towards a touring position such that the camming surface 34 of lobe 30 bears against boss 32 causing the upper portion 26 to separate from chassis 28. As illustrated in FIGS. 13A and 13B, the upper portion 26 is engaged in a touring position with boss 32 resting in detent 36 of lobe 30. In this embodiment, upper portion 26 may also be rotated in the opposite direction to a touring position whereby the lobe on the opposite side of upper portion 26 becomes engaged with boss 32.

Figure 14A:
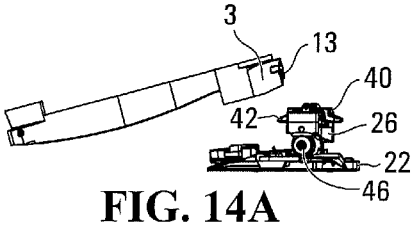
FIGS. 14A and 15A are perspective views of a heel unit of this invention and a boot sole with heel in unweighted (14A) and weighted (15A) situations.
Figure 15A:
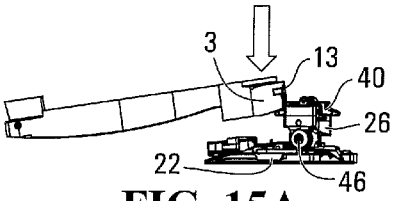
Figure 14B:
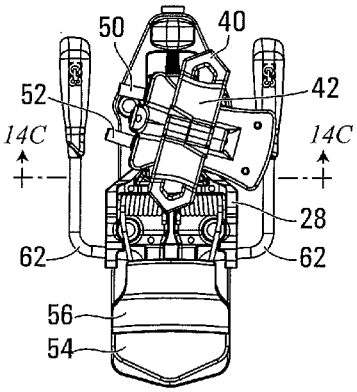
FIGS. 14B and 15B are top views of the heel units illustrated in FIGS. 14A and 15A, respectively.
Figure 15B:
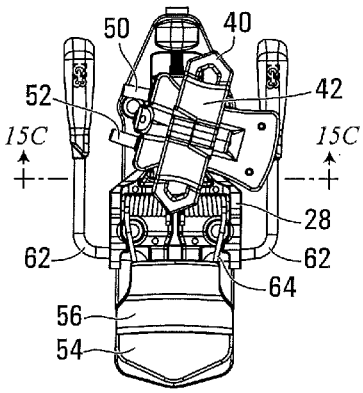
Figure 14C:
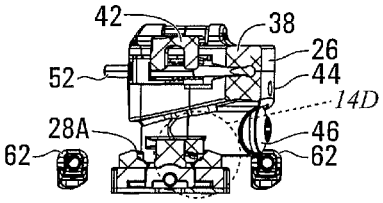
FIGS. 14C and 15C are cross sectional views taken along lines E-E and G-G of FIGS. 14B and 15B, respectively.
Figure 15C:
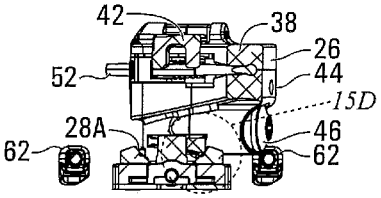
Figure 14D:
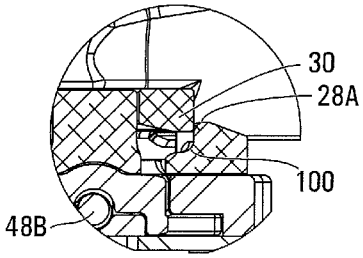
FIGS. 14D and 15D are enlarged views of sections F and H of FIGS. 14C and 15C, respectively.
Figure 15D:
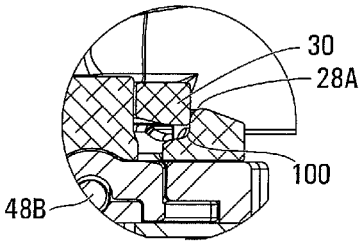
Figure 16B:
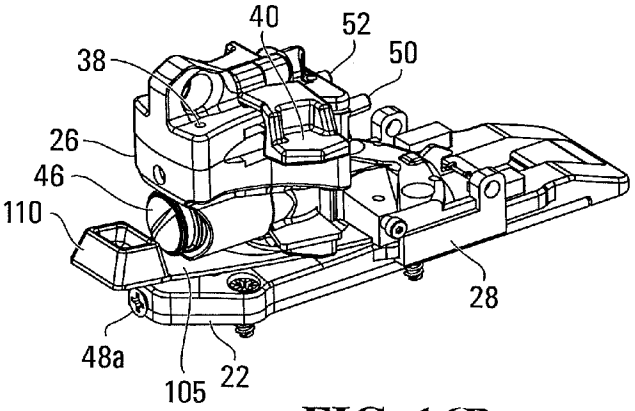
FIGS. 16A and 16B are side and perspective views respectively, of an alternate heel unit of this invention in the downhill mode.
Figure 16A:
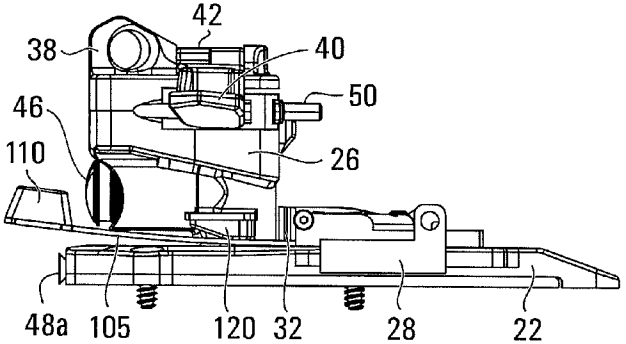

FIG. 14A is a side view showing a heel unit of this invention in a touring position with a boot sole heel 3 shown positioned above the heel unit. The remainder of the boot is not illustrated. FIG. 14B is a top view of the heel unit in FIG. 14A. FIG. 14C is a cross sectional view along line E-E in FIG. 14B. FIG. 14D is an enlarged view of section F illustrated in FIG. 14C. As shown in FIG. 14D, rotation of the heel unit so that lobe 30 engages with brake chassis 28 causes upper portion 26 to translate rearwards relative to chassis 28. In addition to the camming surface of lobe 30 engaging with a boss on chassis 28 as described above, an under surface of lobe 30 rides up and over an inclined portion 28A of chassis 28 to become engaged in depression 100 in chassis 28 that is fixed relative to the upper portion, as illustrated in FIG. 14D. In this embodiment, this is accomplished by the flexing that occurs when lobe 30 is made from a plastic material. As shown in FIG. 14D, a portion of lobe 30 is partially engaged within depression 100. However, when weighted by the user in the touring mode as shown in corresponding FIGS. 15A-15D, lobe 30 is pressed further into depression 100 thereby ensuring that the heel unit will not rotate. When unweighted as shown in FIG. 14D, the user may easily dislodge lobe 30 from depression 100 (for example by use of a ski pole) which allows the upper portion 26 to rotate back to the downhill position. Such rotation may be facilitated by the biasing force of spring 76 as illustrated in the preceding drawings.

Alternate means for restraining and/or locking the upper portion of the heel unit when in the touring position may also be used and may be appropriately adapted to the amount of load on spring 76 and the consequent tendency for the upper portion of the heel unit to tend to return to the downhill position.

Figure 17B:
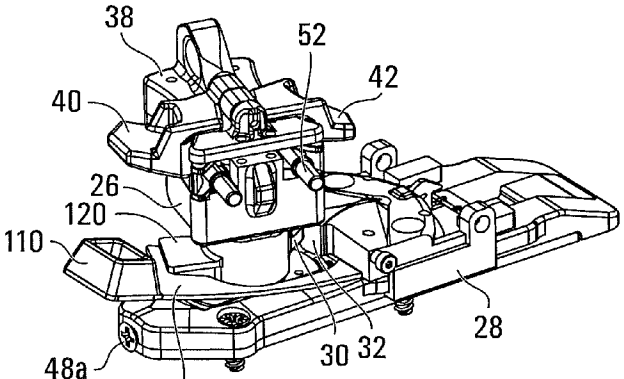
FIGS. 17A and 17B are side and perspective views respectively, of the heel units illustrated in FIGS. 16A and 16B in a touring position.
Figure 17A:
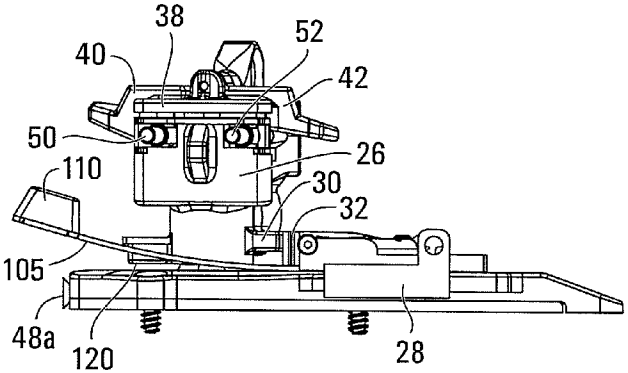

FIGS. 16A and 16B and FIGS. 17A and 17B illustrate an alternate embodiment for restraining upper portion 26 in a touring position. For ease of illustration, this embodiment is shown without a brake present on brake chassis 28. In this embodiment, upper portion 26 comprises a single lobe 30 for engagement with boss 32 on brake chassis 28. On the opposite side from lobe 30 is stop 120 which engages with spring plate 105 when the heel unit is rotated to the touring position as shown in FIGS. 17A and 17B. In such a position, lobe 30 is engaged with boss 32 translating upper portion 26 rearward relative to chassis 28 against the biasing force of a spring as illustrated in the preceding drawings. Engagement of stop 120 with spring plate 105 prevents the upper portion from rotating back to the downhill position as a result of biasing by the aforementioned spring. Cup 110 on the end of spring plate 105 may be present in order to facilitate movement of the spring plate with the user's ski pole. The user pressing down cup 110 results in release of stop 120 from spring plate 105 allowing the heel unit to return to the downhill position under the biasing force of aforementioned spring 76.

Use of a heel unit of this invention where the upper portion is translated rearward relative to the footwear heel when in the touring position is advantageous, particularly when moving through bumpy terrain which can result in significant flexing of the ski. This invention allows for the provision of clearance between the heel unit and the footwear heel in the touring position even if the heel unit is adjusted so that it will be at or near or even pressed against the heel of the footwear when in the downhill mode. Placing the upper portion of the heel unit at a consistent location on or immediately adjacent to footwear heel results in more consistent release characteristics even when the ski is compressed causing the heel unit to be biased forward. The biasing device which holds the upper portion in position against a stop allows the upper portion to translate rearward under force when in the downhill position, to allow for proper functioning of the binding during compression forces being exerted in the ski. In situations where a heel unit of this invention is positioned so that when in engaged with the heel of the footwear, biasing device 76 pre-loads the upper portion of the heel unit against the heel (i.e. to provide for higher release settings), it may be advantageous to provide for a ramp or other means for forcing the heel unit rearwards when engaging the heel of the footwear. Such a ramp may be positioned at a location such as one as inclined region 130 illustrated in FIG. 10.

Although the foregoing invention has been described in some detail by way of illustration and example for purposes of clarity of understanding, it will be readily apparent to those of skill in the art in light of the teachings of this invention that changes and modification may be made thereto without departing from the spirit or scope of the invention. All patents, patent applications and publications referred to herein are hereby incorporated by reference.

The invention claimed is:

1. An apparatus for selective holding of a footwear heel to a snow travel aid, the apparatus comprising a base mountable to the snow travel aid and an upper portion in slidable connection with the base, the upper portion having at least one forward connector for connecting the upper portion to the heel and being rotatable on a generally vertical axis between a downhill position and at least one lateral release position, wherein the upper portion comprises at least one camming surface positioned such that rotation of the upper portion toward the lateral release position results in the upper portion translating rearwardly against an opposing force provided by a forward biasing device, wherein the upper portion remains in connection with the base throughout said translating and the upper portion is configured to be releasably retained in the lateral release position against the force provided by the forward biasing device.

2. The apparatus of claim 1, further comprising Mz and My biasing devices, separate from the forward biasing device.

3. The apparatus of claim 1, wherein the camming surface contacts a stop that is fixed relative to the upper portion.

4. The apparatus of claim 3, wherein the stop is a boss connected to the base.

5. The apparatus of claim 4, wherein the boss is on a chassis connected to the base, the base being positionable on the snow travel aid by an adjustor and wherein the upper portion is slidably engaged with the base.

6. The apparatus of claim 5, further comprising a snow brake mounted on the chassis.

7. The apparatus of claim 1, wherein the camming surface is on a lobe connected to the upper portion.

8. The apparatus of claim 7, comprising two lobes on opposite sides of the upper portion and wherein the upper portion is rotatable in opposite directions.

9. The apparatus of claim 1, wherein the releasable retaining is provided by a detent in the camming surface.

10. The apparatus of claim 7, wherein the releasable retaining is provided by the lobe engaging a depression that is fixed relative to the upper portion, wherein the lobe engages the depression in the rotated position.

11. The apparatus of claim 10, wherein the depression is behind an inclined part and wherein the lobe rides up the inclined part during rotation toward the rotated position.

12. The apparatus of claim 10, wherein the lobe is sufficiently flexible to facilitate engagement with the depression.

13. The apparatus of claim 10, wherein the apparatus is configured such that weighting the apparatus by a user inhibits disengagement of the lobe from the depression.

14. The apparatus of claim 1, wherein the at least one connector is a pair of pins.

15. A system comprising a ski and a touring binding mounted to the ski and a ski boot placed in the binding, wherein the touring binding comprises the apparatus defined in claim 14, and wherein the apparatus is positioned such that there is no clearance between the heel of the ski boot and the upper portion of the apparatus, when said pair of pins is engaged with the heel of the ski boot.

* * * * *